United States Patent [19]

Tom

[11] 4,294,280

[45] Oct. 13, 1981

[54] APPARATUS FOR PRODUCING AND DISPENSING DETERGENT SOLUTIONS

[76] Inventor: Milton D. Tom, R-1, Norwich, Ohio 43767

[21] Appl. No.: 56,309

[22] Filed: Jul. 10, 1979

[51] Int. Cl.[3] ..... B05B 7/00

[52] U.S. Cl. ..... 137/268; 239/310; 422/263; 422/266

[58] Field of Search ..... 137/268, 205.5, 564.5, 137/599, 599.1; 239/310, 312; 422/266, 261, 263, 267

[56] References Cited

U.S. PATENT DOCUMENTS 2,502,140 3/1950 Friendlich ..... 239/312

2,602,699 7/1952 Otto ..... 239/310 X 3,628,732 12/1971 Vicari ..... 239/310

*Primary Examiner*—Alan Cohan

*Attorney, Agent, or Firm*—Cushman, Darby & Cushman

[57] ABSTRACT

A device for supplying a detergent to a liquid dispenser such as a showerhead or the like includes a body having a hollow interior, a housing attached to the body and a valve support member including a flap valve mounted on said support member in the chamber, the flap valve being manually controlled to divert flow from the body's inlet into the housing where a solid detergent cake is stored; the housing is oriented so as to drain through a second aperture to the outlet of the device.

7 Claims, 3 Drawing Figures

APPARATUS FOR PRODUCING AND DISPENSING DETERGENT SOLUTIONS

BACKGROUND AND SUMMARY OF THE INVENTION

The present invention relates to apparatus for adding detergent solutions to wash water and, more particularly, to an attachment that can be installed upstream of a showerhead and which is manually adjustable to pass the water through a water soluble detergent tablet or cake or to bypass the detergent and supply rinsewater to the showerhead or nozzle.

The prior art has proposed a number of different types of detergent additive devices for washbasins, showers or the like. In general, such devices have employed various types of valves to divert a part or all of the waterflow from a source through a container in which the detergent is housed before the mixed detergent and water is passed to a delivery nozzle. In one group of prior art devices, the detergent must be in liquid form in order to be utilized in the device. While such devices have operated satisfactorily, the packaging and storing of detergent in liquid form is more expensive and space consuming than where the detergent is in a cake or tablet form. In devices where the detergent is in a powdered, cake or tablet form of the type which provides a sudsy solution when contacted with water, one problem that has been encountered is insufficient generation of soapy water due to the difficulty in diverting the liquid flow from the source with sufficient turbulence about the cake or bar of detergent. In other arrangements, with this type of detergent package, subsequent to the shut-off of the water, the residue of undissolved or partially dissolved detergent has tended to block the passageways and valves of the devices thus causing great inconvenience to the user. Other types of devices have required complicated plumbing arrangements and valves which are essential to their operation and which are correspondingly difficult to install as well as to clean.

Prior art representative of this field is listed below.

Belmont, U.S. Pat. No. 2,120,774
Otto, et al, U.S. Pat. No. 2,602,069
Heald, U.S. Pat. No. 3,231,200
Swimmer, U.S. Pat. No. 1,248,573
Gordon, U.S. Pat. No. 2,325,242
Donaldson, U.S. Pat. No. 2,135,969
Chase, U.S. Pat. No. 2,562,415
Wukowitz, U.S. Pat. No. 3,106,345

The present invention provides an improved soap dispensing apparatus which avoids the foregoing as well as other difficulties encountered with prior art devices and yet which is very inexpensive to manufacture and one which can be installed without special tooling for domestic use although it is not limited to this application. Further, the device of the present invention is virtually self-cleaning and makes it possible to easily replace a depleted supply of soap in solid form.

To summarize the present invention, a hollow body is provided with a threaded inlet and outlet generally aligned along the axis of the body and a flap valve is disposed in an interior chamber of the body. The flap valve is mounted on a pin which has one end extending through a wall of the body to facilitate manual adjustment of the flap valve. A soap dispensing housing is provided on one side of the body with an open end of the housing surrounding two apertures formed on either side of the flap valve support. The flap valve is arranged to direct flow from the inlet to the chamber into the housing containing the detergent package while the other aperture in the body empties into the chamber downstream of the flap valve so that any drainings after the liquid is shut off will not come into contact with the valve mechanism. Further, with the device properly oriented for gravity flow, the detergent residue and liquid remaining after use will drain out of the apparatus entirely.

The foregoing and other advantages will become apparent as consideration is given to the following detailed description taken in conjunction with the accompanying drawings, in which:

DETAILED DESCRIPTION OF THE INVENTION

Figure 1:
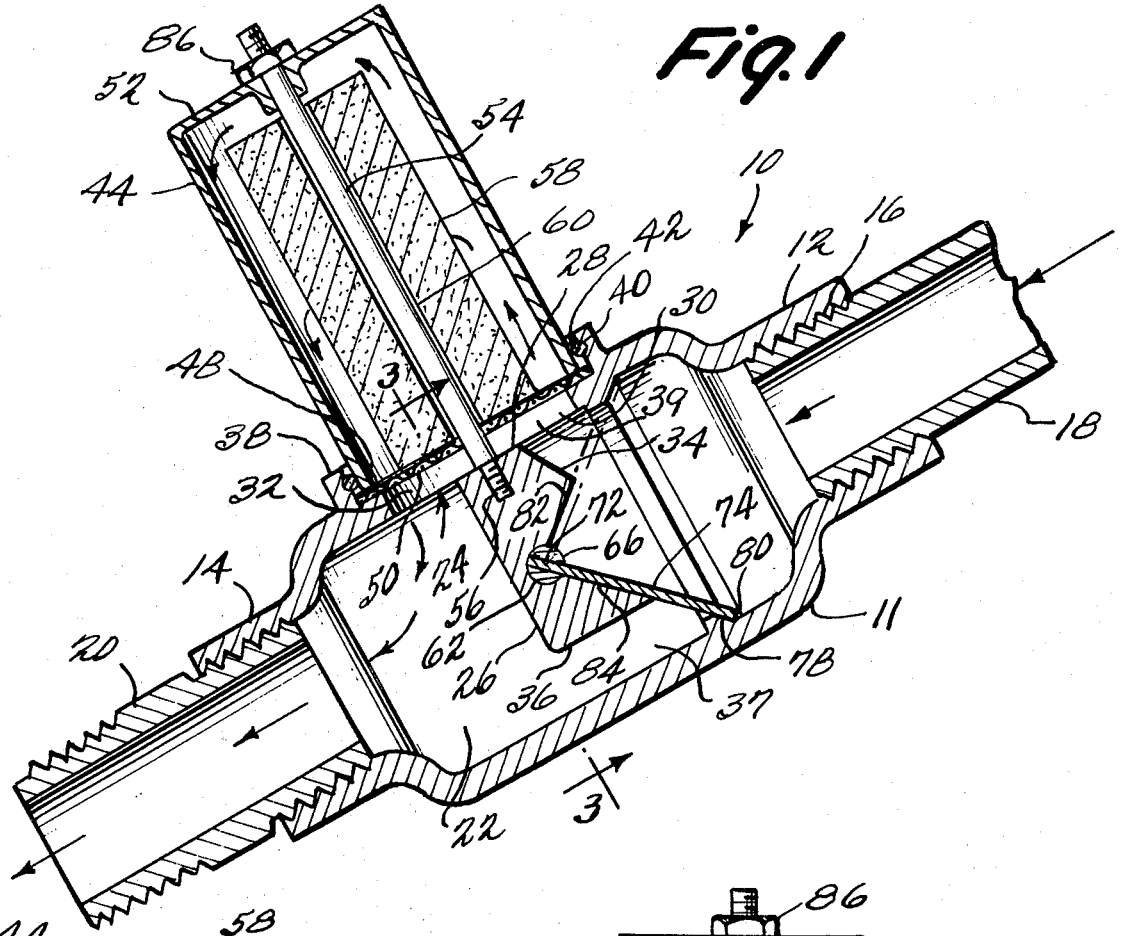
FIG. 1 is a sectional view in elevation of the device of the present invention.

Referring now to the drawings, wherein like numerals designate corresponding parts throughout the several views, in a preferred embodiment, the device of the present invention illustrated at 10 in FIG. 1 may be made from a corrosion-resistant metal or high-impact plastic in the form of a tubular body 11 having narrowed ends 12 and 14 which may be interiorly threaded as at 16 or exteriorly threaded (not shown) to facilitate connection to a pipe such as a shower neck illustrated at 18. The outlet 14 may be similarly threaded for connection to a pipe or showerhead connection as at 20.

Figure 3:
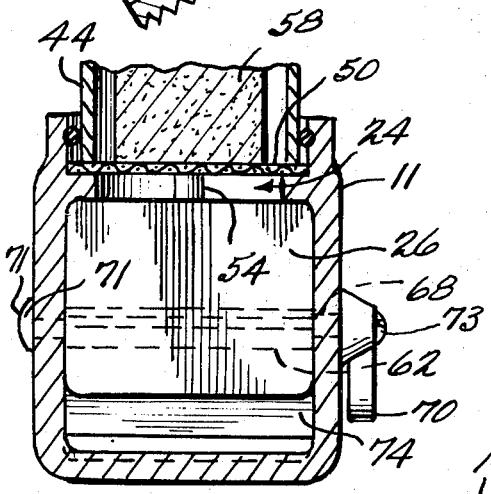
FIG. 3 is a view taken along lines 3—3 of FIG. 1.
Figure 2:
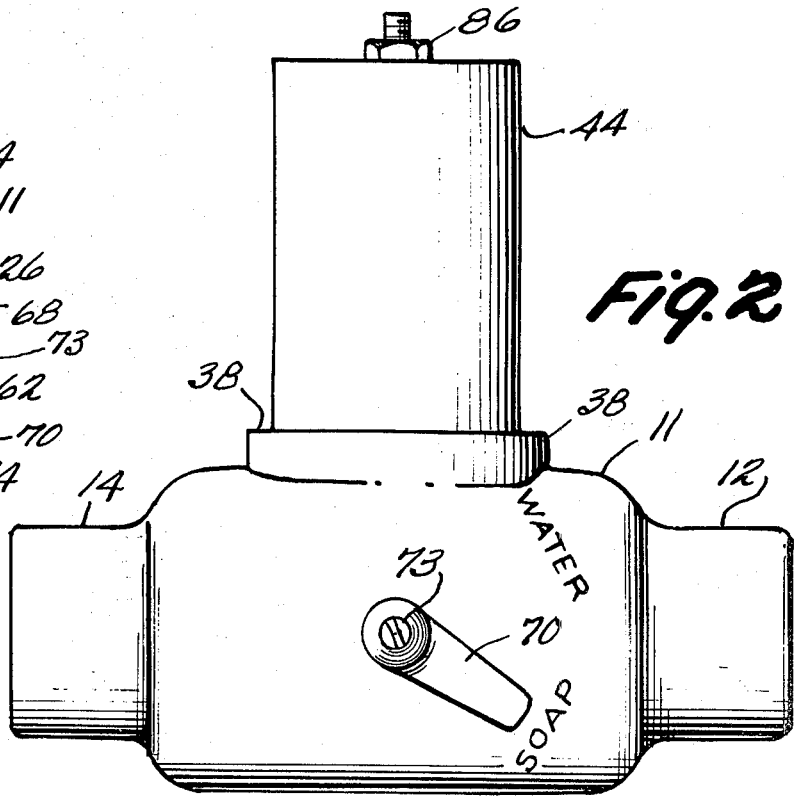
FIG. 2 is a side view in elevation of the device of FIG. 1.

The body 11 has an interior hollow chamber 22 and an enlarged opening generally indicated at 24. Mounted on an interior wall of the chamber 22 is a valve support member 26 which, as shown in FIG. 3, extends across the chamber 22. The upper side 28 of the valve support member 26 divides the opening 24 into a first aperture 30 disposed on the inlet side of the valve support member 26 and a second aperture 32 located on the downstream side of the valve support member 26. The valve support member 26 also has a wall surface 34 which defines a portion of a flow passage leading to the first aperture 30 and a second wall surface 36 which defines a portion of a second flow passage leading to the downstream side of the valve support member 26 and directly to the outlet 14. An upwardly extending annular flange 38 surrounds the first and second apertures 30 and 32 and is provided with an interior groove 40 for receiving an O-ring seal 42. A housing or cover 44 which may be cup-shaped has an open end 48 which snugly engages the O-ring 42 in liquidtight engagement therewith. The open end 48 of the housing 44 is provided with a filtering means in the form of a brass or plastic screen 50. The closed end 52 of the housing 44 has an opening for receiving a threaded rod 54 which extends axially of the housing 44 to engage a threaded bore 56 in the upper edge 28 of the valve support member 26.

With the arrangement as thus far described in a preferred embodiment, a cake of solid detergent 58 having dimensions smaller than the interior wall dimensions of the housing 44 and formed with a central bore 60 may be held by rod 54 as illustrated in FIG. 1 spaced inwardly from the interior walls of the housing 44.

Additionally, it will be noted that when the aperture 32 is located vertically above the chamber 22 and the outlet 14, any soapy liquid or detergent residue will drain from the housing 44 into the chamber 22 so as to be readily flushed out of the chamber 22 through outlet 14 without interfering with the operation of the valve means of the present invention which will now be described.

The valve support member 26 has a centrally located channel 62 which extends generally transverse to the direction of flow of water through the chamber 22. A pivot pin 66 has one end thereof frictionally held in the channel 62 and extends across the chamber 22 and through an aperture 68 formed in the opposite wall of the body 11 and exteriorly of the body as clearly illustrated in FIG. 3. A handle 70 is secured as by a bolt 73 to the protruding end of the pivot pin 66 to facilitate manual rotation of the pivot pin. The opposite end of pin 66 extends through an aperture in the opposite wall of the chamber 22 and is held by a bolt or rivet 71.

Returning to FIG. 1, along its length, the pivot pin 66 is provided with a slot 72 into which one edge of a flap valve 74 is inserted and held as by screws or adhesive glue, or other suitable means. The flap valve 74 has dimensions so that it will completely block off liquid flow through passage 37 and the lower portion of chamber 22 when the valve member 74 is in the position illustrated in solid lines in FIG. 1 or through passage 39 and the upper portion of chamber 22 when the valve member 74 is in the dotted line position of FIG. 1. Of course, it will be understood, that the valve member 74 may assume an intermediate position between these two extremes to provide gradations in the amount of detergent added to the water flowing through the body 11.

The interior wall of the chamber 22 is provided with a pair of abutment grooves one being shown at 76 adjacent the first aperture means 30 and the other one 78 being disposed adjacent the flow passage 37. The outer edge 80 of the flap valve 74 will abut the bottom of a respective groove when the flap valve 74 is in one of its extreme positions. Further, the valve support member 26 has stop means in the form of a surface 82 for the up position and a surface 84 for the down position to provide support for the flap valve when in the respective position. Both the frictional resistance to rotation of the pivot pin 66 as well as the force of the water flowing into chamber 22 from inlet 12 will maintain the flap valve 74 in either of its extreme positions once the flap valve is set therein. As noted above, however, the valve may be manually held in any intermediate position, as desired.

It will be noted that the stop surfaces 82 and 84 are angled with respect to the direction of flow of the water from the inlet 12 so that the flap valve 74, when resting on either of these surfaces will act as a flow deflector to at least partially deflect the water towards the selected flow passage 37 or 39.

It will be appreciated that the orientation of surfaces 34 and 82 will contribute to the creation of turbulence which is useful in the generation of soapy water by facilitation of the disintegration of the detergent cake 58. Also, the cross-sectional area of the opening 39 can be made non-uniform across the width of the body so that additional useful turbulence will be created.

Upon depletion of the detergent cake 58, a new cake may be inserted by simply unthreading nut 86 and removing pins 60 and housing 44 to enable the rapid insertion of a fresh cake of detergent. It will be appreciated that, while the illustrated detergent cake 58 is preferred, other shapes of solid detergent may be usefully employed.

Having described the invention, it will be apparent to those skilled in this art that various modifications may be made therein without departing from the spirit and scope of the invention as defined in the appended claims.

I claim:

1. A device for selectively supplying a cleansing solution to a liquid conduit comprising:

a body having an interior chamber, inlet means for passing a liquid into said chamber, outlet means for discharging the liquid from said chamber, first aperture means in said body, and second aperture means in said body spaced from said first aperture means, housing means for a cleansing material, said housing means having an open end removably mounted on said body so as to completely surround said first and second aperture means.

said chamber having valve support means therein, a flap valve movably carried by said valve support means so as to be movable between a first position, wherein liquid from said inlet means passes through said chamber to said outlet means, and a second position wherein liquid passes from said inlet means into a portion of said chamber and then through said first aperture means into said housing means, through said second aperture means back into said chamber and then to said outlet means, said second aperture means being disposed downstream of said valve support means and said flap valve so as to be in flow communication with said outlet means through said chamber when said flap valve is in either said first or second positions so that any liquid in said housing means will drain from said housing when said housing is located vertically above said chamber and said outlet means.

said valve support means including first wall means defining a first flow path and a portion of said chamber adjacent said first aperture means for directing liquid through said first aperture means into said housing means, and said valve support means including second wall means defining a second flow path in a portion of said chamber remote from said first aperture means and first flow path for directing liquid through said chamber to said outlet means.

2. The device as claimed in claim 1 wherein said valve support means includes first stop means associated with said first position for said flap valve whereby, when said flap valve engages said first stop means, liquid flow contacting said flap valve will at least partially be deflected toward said first aperture means and said second flow path will be closed by said flap valve.

3. The device as claimed in claim 2 wherein said valve support means includes second stop means associated with said second position for said flap valve whereby, when said flap valve engages said second stop means, liquid flow contacting said flap valve will at least partially be deflected toward said second flow path in said chamber and said first aperture means will be closed by said flap valve.

4. The device as claimed in claims 2 or 3 wherein said flap valve has a first edge mounted on a pivot pin, said pivot pin being rotatably mounted on said valve support means generally transverse to the direction of liquid flow through said chamber, said body having an opening and said pivot pin having one end extending through said opening exteriorly of said body to permit manual rotation of said pivot pin, said flap valve having a second edge at its extremity remote from said first edge, said chamber having first and second spaced apart groove means for engaging said second edge of said flap valve when said flap valve is in said first or second positions, respectively.

5. The device as claimed in claim 1 wherein said housing means for a cleansing material is cup-shaped and has a closed end, threaded pin means extending generally axially of said housing means and through said closed end, said valve support means having a threaded bore for receiving said threaded pin means whereby said pin means will engage and hold a cleansing material in a selected position in said housing means.

6. The device as claimed in claim 5 wherein said housing means has interior walls and the cleansing material is a solid cake of detergent having a central bore through which said threaded pin means extends, said cake having exterior dimensions that are smaller than the interior dimensions of said housing means so that said cake will be held out of contact with said interior walls of said housing means by said threaded pin means.

7. As claimed in claims 1, 5 or 6 wherein said open end of said housing means is covered by a filtering means

* * * * *